United States Patent [19]

Katz

[11] 4,000,769

[45] Jan. 4, 1977

[54] BELT-SUPPORTED CAMERA CARRYING CASE

[76] Inventor: Bruce J. Katz, 315 E. 86th St., New York, N.Y. 10028

[22] Filed: Dec. 3, 1975

[21] Appl. No.: 637,166

[52] U.S. Cl. ..... 150/52 J; 206/316

[51] Int. Cl.[2] ..... B65D 65/08

[58] Field of Search ..... 224/5 V; 150/52 R, 52 J; 206/316

[56] References Cited

UNITED STATES PATENTS

| | | | |
|---|---|---|---|
| 2,136,357 | 11/1938 | Darling | 224/5 V |
| 2,616,473 | 11/1952 | Katz | 224/5 V |
| 2,960,137 | 11/1960 | Lipsitz | 150/52 J |
| 3,813,017 | 5/1974 | Pimsleur | 150/52 J |
| 3,910,470 | 10/1975 | Swenson | 224/5 V |

FOREIGN PATENTS OR APPLICATIONS

| | | | |
|---|---|---|---|
| 75,891 | 6/1959 | France | 150/52 J |
| 811,905 | 7/1949 | Germany | 150/52 J |
| 502,130 | 11/1954 | Italy | 150/52 J |

*Primary Examiner*—Ro E. Hart

*Attorney, Agent, or Firm*—Bauer, Amer & King

[57] ABSTRACT

A belt-supported camera carrying case having an outer fabric body or enclosure, and a plastic foam insert which both cushions a camera in its storage position within the case against shock, and also holds the fabric enclosure in a three-dimensional shape to facilitate placement of the camera within the case.

4 Claims, 9 Drawing Figures

BELT-SUPPORTED CAMERA CARRYING CASE

The present invention relates generally to an improved camera carrying case, and more particularly to a camera carrying case that can be effectively worn on the user's belt. This position frees the user's hands, and also obviates the discomfort of a shoulder strap or the like, as well as providing other benefits over known conventional camera carrying cases.

As may be readily appreciated, supporting a camera carrying case from the user's belt, as distinguished from a strap or belt which is looped over the user's shoulder, imposes use conditions which do not ordinarily exist. Firstly, the position of the case on the user's belt somewhat limits his ability to make adjustments during placement of the camera within the case and its removal therefrom. That is, the attachment of the case to the user's belt does not permit the case to be turned into different orientations or otherwise manipulated during placement or removal of the camera. Further, the walking, running or other movements of the user are of course experienced by the camera in its storage position within the case and, unless prevented from doing so, may cause damage to the delicate mechanisms of the camera. It is undoubtedly because of the foregoing, and possibly other similar reasons, that belt-supported camera carrying cases are not in popular use.

Broadly, it is an object of the present invention to provide an improved belt-suspended or supported camera carrying case overcoming the foregoing and other shortcomings of the prior art. Specifically, it is an object to provide an improved camera carrying case in which the camera is effectively cushioned against shock and which is three-dimensionally shaped, for ease of placement of the camera therein, without use of expensive construction materials such as leather or the like.

A belt-supported camera carrying case demonstrating objects and advantages of the present invention includes an outer fabric enclosure member including walls cooperating to bound a T-shaped storage compartment for the camera, said compartment having an upper access opening. A pair of triangular-shaped side flaps formed with pockets therein are located for opening and closing movement along opposite sides of the compartment opening. Further, a rear flap is located for opening and closing movement over said side flaps along the rear edge of the compartment opening. Completing the case is a plastic foam insert for the enclosure member, said insert including a depending portion having an operative position located about the storage compartment and thereby effective to cushion a camera positioned therein against shock. The insert also has triangular-shaped upper portions thereon located to be projected within the pockets of the side flaps. As a consequence, the plastic foam insert is maintained in place within the fabric enclosure member and, in addition to protecting the camera against shock, also contributes an external shaping thereto which facilitates placing the camera within the case.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 9:
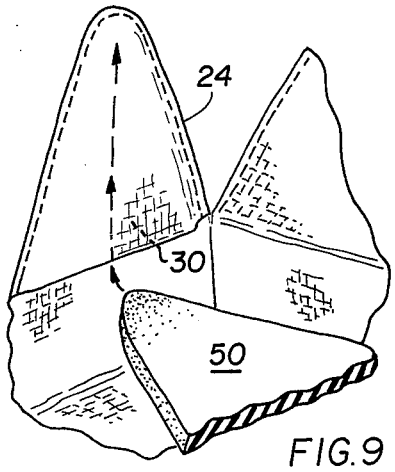
Figure 6:
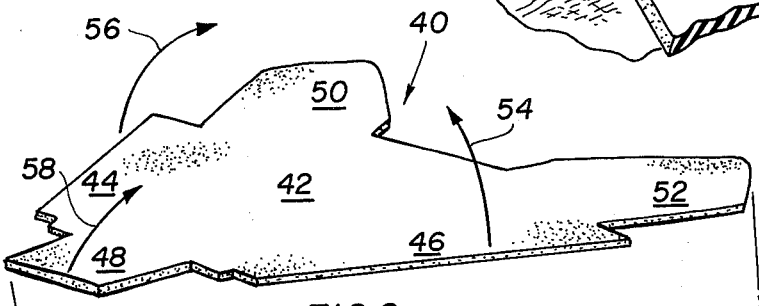
FIG. 6 is a perspective view of the plastic foam insert, the same being shown in the flat.
Figure 7:
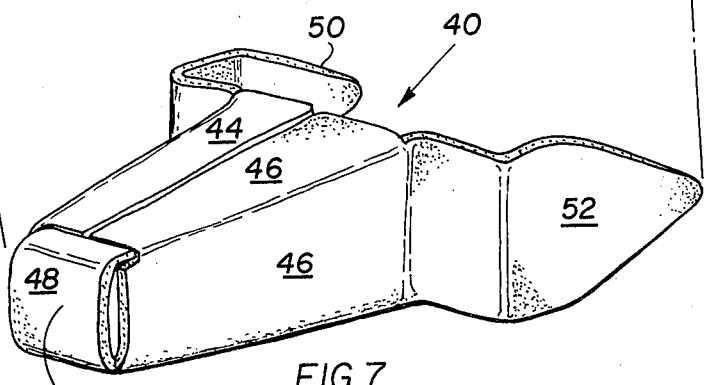
FIG. 7 is also a perspective view of the plastic foam insert, but illustrating the same after it has been folded into its three-dimensional shape.
Figure 8:
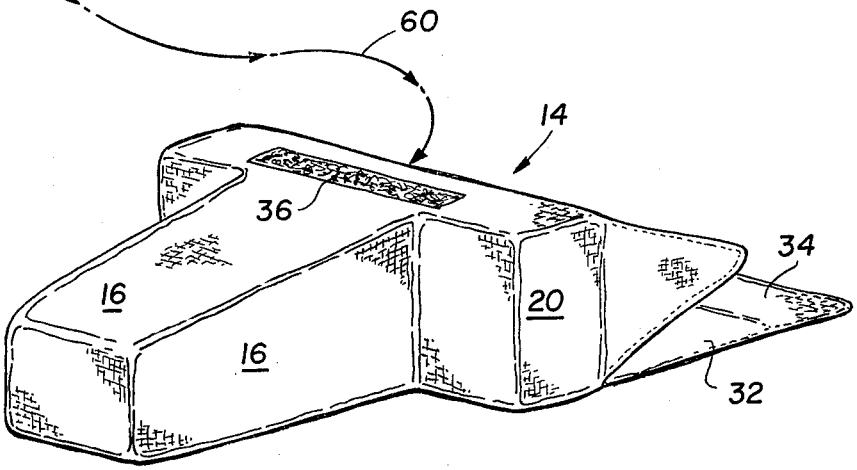

FIG. 8, a figure to be viewed in conjunction with FIGS. 6 and 7, illustrates how the plastic foam insert is to be placed within the outer fabric enclosure member preparatory to contributing to providing an external three-dimensional shaping thereof; and FIG. 9 is a partial perspective view illustrating how the plastic foam insert and outer fabric enclosure member cooperate to form a composite camera carrying case.

Figure 1:
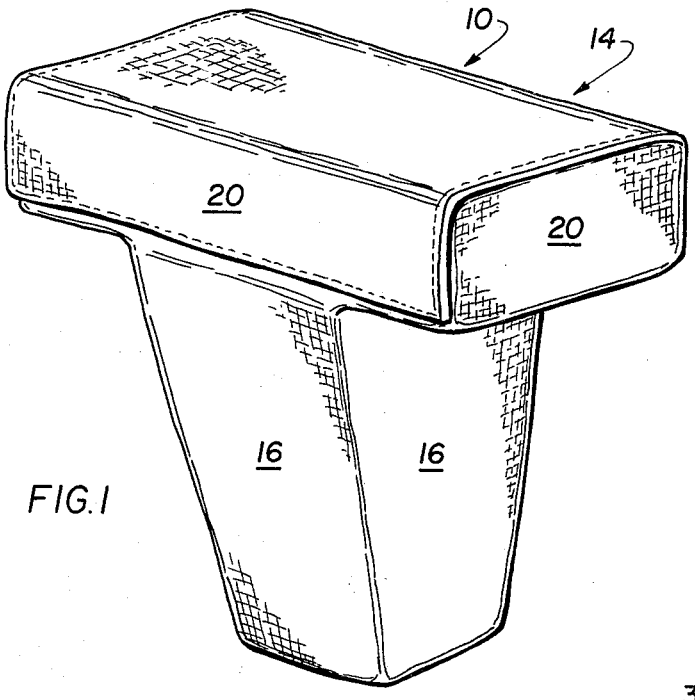
FIG. 1 is a perspective view of the camera carrying case hereof.
Figure 2:
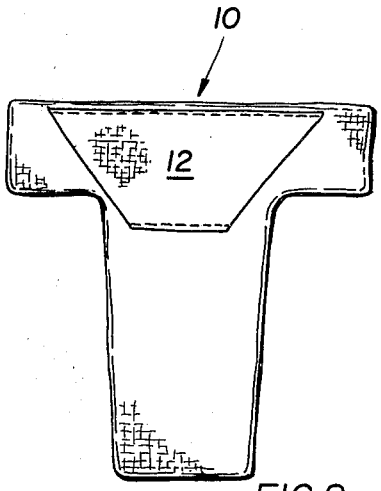
FIG. 2 is a rear view thereof showing the rear loop for the user's belt.
Figure 3:
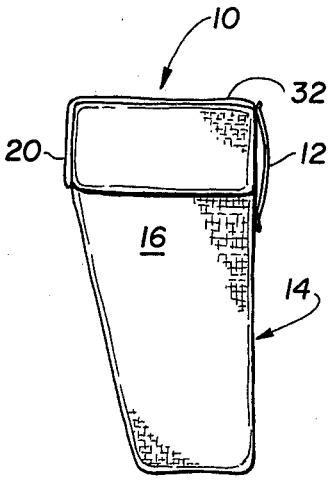
FIG. 3 is a side elevational view of the carrying case.

The camera carrying case, generally designated 10, illustrated in the drawings is intended to be supported from the belt of the user and, to this end, as illustrated in FIG. 2, includes a rear loop 12 through which the user's belt is threaded. As a consequence, as illustrated in FIG. 3, the carrying case 10 in use is generally suspended vertically and is positioned against the body of the user. In accordance with the present invention, it is recognized that providing this type of support for the carrying case 10, as distinguished from a strap or belt which is looped over the shoulder of the user, imposes use conditions which do not ordinarily exist. For example, the position of the case 10 on the user's belt somewhat limits the user in his ability to make adjustments during placement of the camera within the case and its removal therefrom. In other words, the attachment of the case 10 to the user's belt does not permit the case to be turned into different orientations or otherwise manipulated during placement or removal of the camera. Also, the walking, running or other movements of the user are of course experienced by the camera in its storage position within the case 10 and, unless prevented from doing so, may cause damage to the delicate mechanisms of the camera. This is to be contrasted with a shoulder strap supported carrying case which the user can physically take hold of and make appropriate compensation for any rough movements.

With the above in mind, the within carrying case 10 includes noteworthy and novel means which permit its use in supported position from the user's belt, without any adverse consequence. Among other advantages, this belt-supported position for case 10 completely frees the user's hands for other things, since he need not be concerned about a hand movement which would inadvertently result in the shoulder strap falling off of his shoulder. Also, the discomfort and restrictions imposed by a shoulder strap are completely eliminated.

The within belt-supported carrying case 10 hereof is comprised of two members. The first, which is illustrated on the drawing sheet of FIGS. 1–4, consists of an outer fabric enclosure member which may be made of canvas or other rough-wearing material. As clearly illustrated in FIGS. 1–4, the said outer fabric enclosure member, generally designated 14 in FIGS. 1–4, includes a depending portion formed by a cooperating arrangement of walls, individually and collectively designated 16, which bound the generally trapezoidal internal storage compartment 18. (See in particular FIG. 5.) It will be recognized that the shape of compartment 18 is appropriate to receive the lens structure of a camera after said lens structure is appropriately turned to extend in a downward fashion from the body of the camera.

The fabric enclosure member 14 also has walls, individually and collectively designated 20, which cooperate to bound a generally horizontally oriented volume or storage compartment portion 22. (See in particular FIG. 4.) The storage compartment portion 22 will be readily recognized as being appropriately oriented and sized to receive the camera body per se. Thus, the compartments 18 and 22 cooperate to form a composite generally T-shaped compartment which is adapted to receive most conventionally shaped cameras which have a body and front lens structure. As already noted, the camera should be placed in the T-shaped compartments 18–22 so that the lens structure extends into the vertically oriented leg 18 and the body of the camera into the upper or horizontally oriented leg 22 of the compartment.

Figure 4:
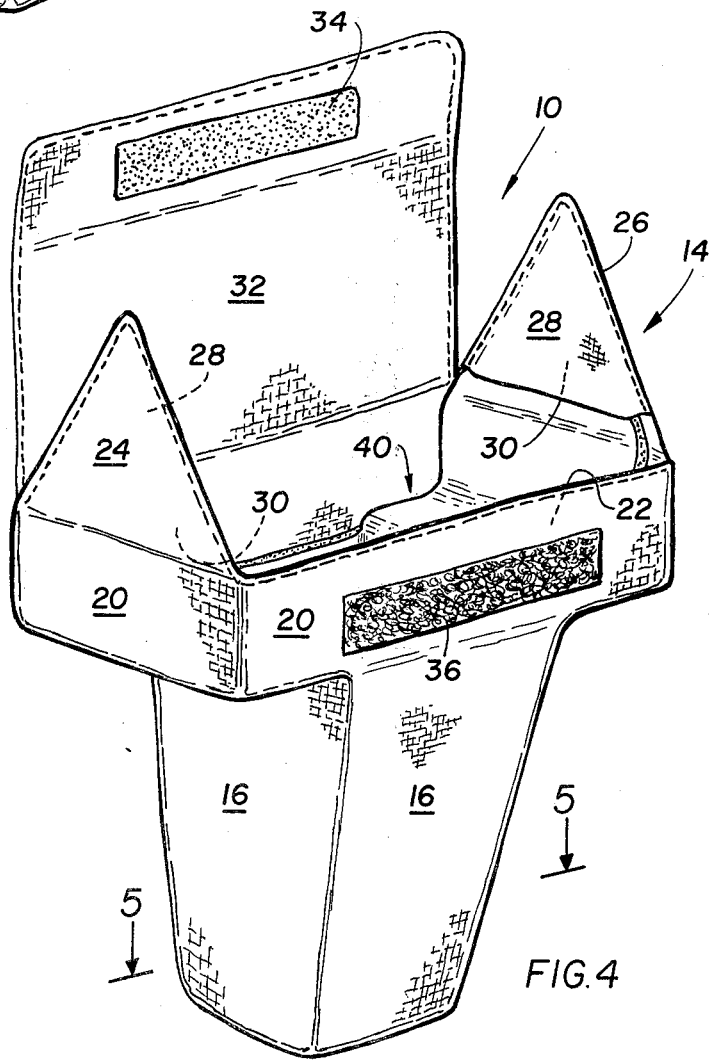
FIG. 4 is another perspective view of the carrying case, but with the flaps open defining an access opening into the storage compartment of the case.

Completing the external fabric enclosure member 14 is a pair of side flaps 24 and 26 located, as clearly illustrated in FIG. 4, along the opposite sides of the opening 22 into the storage compartment of the carrying case 10. Each of the flaps 24 and 26 has an additional piece of fabric 28 sewn along its under-surface so as to form a pocket 30, the purpose of which will soon be apparent.

Located rearwardly of the carrying case 10 is a rear flap 32 having a "velcro" strip 34 appropriately attached thereto and which cooperates with a "velcro" strip 36 connected along the front of the carrying case, thereby enabling the rear flap 32, after the side flaps 24 and 26 are folded down, to fold over these side flaps and thereby form a closure for the storage compartment opening 22. The closed position of the carrying case 10 is illustrated in FIG. 3.

The other significant component of the carrying case 10 is illustrated on the drawing sheet containing FIGS. 5–9. Specifically, this component consists of the die-cut shape of plastic foam in the preferred shape illustrated in FIG. 6. This foam sheet, generally designated 40, in the flat as illustrated in FIG. 6, includes a central body 42 having side flaps or extensions 44 and 46 and a bottom extension 48. Also, extending from the upper portion of the body 42 are two generally triangular portions 50 and 52.

The plastic foam insert 40 develops into a three-dimensional shape in the manner illustrated in FIG. 7. Specifically, the side extensions 46 fold in the direction 54 upon the body 42 forming a side and part of a front for the previously noted trapezoidal shaped compartment 18. In like fashion, the other side 44 folds in the direction 56 and provides the other side of the compartment and the other cooperating half of the front for the same. The bottom flap or extension 48 folds in the direction 58 across the bottom of the compartment 18 and slightly up along the front portions 44 and 46, all as is clearly illustrated in FIG. 7.

Also as is clearly illustrated in FIG. 7, by virtue of the folding movements 54 and 56 of the side portions 44 and 46, the triangular portions 52 and 50 are changed 90° in their orientation. That is, whereas in FIG. 6 the flaps 50 and 52 are in the same horizontal plane as the body 42, after the folding movements 54 and 56, these flaps, like the sides 44 and 46 are turned perpendicularly of the horizontal plane of the body 42. As a consequence, the flaps 50 and 52 are in the proper orientation to be inserted into the pockets 30 which, previously in the description were noted as being formed in each of the side flaps 24 and 28.

Figure 5:
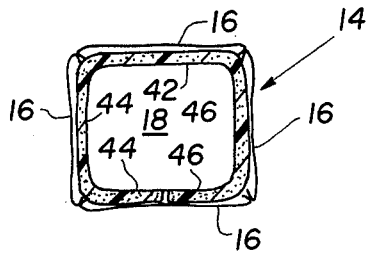
FIG. 5 is a top plan view, in section taken on line 5—5 of FIG. 4, illustrating how the plastic foam insert provides cushioning against shock and also assists in shaping the case.

More particularly, it should be readily understood from progressive examination of FIGS. 7 and 8, that once the plastic foam insert 40 is provided with its three-dimensional shape as illustrated in FIG. 7, it is readily adapted to be inserted and projected, as illustrated by the reference line designated 60 into the interior of the outer fabric enclosure member 14. As a consequence, and as is perhaps best illustrated in FIG. 5, this placement of the insert 40 internally of the fabric enclosure 14 locates the various portions of the insert in a cooperative relation with each other so as to hold apart the walls 16 of the fabric enclosure member 14 in positions which bound, and thereby provide, the internal storage compartment 18. Specifically, as illustrated in FIG. 5, the insert portions 42, 44 and 46, because of the inherent resiliency of the plastic foam, exert an outward bias against the fabric walls 16 to provide the internal storage volume or compartment 18.

The cooperative interfitting of the insert 40 within the outer fabric enclosure member 14 is completed by insertion of the triangular portions 50 and 52 within a cooperating pocket 30 in each of the side flaps 24 and 28. For completeness sake, in FIG. 9 it is illustrated how the triangular portion 50 is inserted into pocket 30 of flap 24. In practice, it has been found that placement of the plastic foam triangular portions 50 and 52 in the pocket portions of the flaps 24 and 26 assists in holding the insert 40 in place within the T-shaped storage compartments 18, 22 of the carrying case 10. This, of course, is desirable since the plastic foam insert 40 cushions the camera in the case 10 against shock and, as already explained, also significantly contributes in providing three-dimensional shaping to the outer fabric 14 of the carrying case.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A belt-supported camera carrying case comprising an outer fabric enclosure member including walls cooperating to bound a T-shaped storage compartment for said camera having an upper access opening into said storage compartment, a pair of triangular-shaped side flaps formed with pockets therein located for opening and closing movement along opposite sides of said compartment opening, a rear flap located for opening and closing movement over said side flaps along the rear edge of said compartment opening, and a plastic foam insert for said enclosure member including a depending portion having an operative position located about said storage compartment effective to cushion a camera positioned therein against shock, and having triangular-shaped upper portions thereon located to be projected within said pockets of said side flaps, whereby said plastic foam insert is maintained in place within said fabric enclosure member to contribute an external shaping thereto which defines said storage compartment and facilitates the placement of said camera therein.

2. A belt-supported camera carrying case as defined in claim 1 including cooperating attaching means on the inside end of said rear flap and along the front of said enclosure member.

3. A belt-supported camera carrying case as defined in claim 2 wherein said plastic foam insert is of a sufficient thickness to add a corresponding bulk to said fabric enclosure member to hold said fabric of said member in a three-dimensional T-shape.

4. A belt-supported camera carrying case as defined in claim 3 wherein the depending leg of said T-shaped storage compartment is sized to receive the lens structure of said camera, and said horizontally oriented leg of said T-shaped compartment is sized to receive the body of said camera.

* * * * *